US009113677B2

(12) United States Patent
Anderson et al.

(10) Patent No.: US 9,113,677 B2
(45) Date of Patent: Aug. 25, 2015

(54) BELT BUCKLE SYSTEM

(76) Inventors: Jesse Anderson, Boise, ID (US); Vikki Anderson, Boise, ID (US)

( * ) Notice: Subject to any disclaimer, the term of this patent is extended or adjusted under 35 U.S.C. 154(b) by 89 days.

(21) Appl. No.: 13/543,515

(22) Filed: Jul. 6, 2012

(65) Prior Publication Data

US 2013/0174383 A1 Jul. 11, 2013

Related U.S. Application Data

(60) Provisional application No. 61/505,429, filed on Jul. 7, 2011.

(51) Int. Cl.
*A44B 11/00* (2006.01)
*A44B 11/22* (2006.01)

(52) U.S. Cl.
CPC ..... *A44B 11/001* (2013.01); *A44B 11/22* (2013.01); *A44B 11/226* (2013.01); *Y10T 24/406* (2015.01); *Y10T 24/4098* (2015.01)

(58) Field of Classification Search
CPC ..... A44B 11/04; A44B 11/001; A44B 6/00; A44B 11/22; A44B 11/226; A44D 2203/00; A41F 1/002; Y10T 24/4098; Y10T 24/406
USPC ..... 24/186, 163 K, 66.1, 303
See application file for complete search history.

(56) References Cited

U.S. PATENT DOCUMENTS 2,601,424 A * 6/1952 Baker ..... 24/66.1
2,659,169 A * 11/1953 Brennan ..... 40/1.5
3,027,617 A * 4/1962 Gray ..... 24/303
3,063,118 A * 11/1962 Salter et al. ..... 24/303
3,908,239 A * 9/1975 Gorman ..... 24/163 K
3,913,147 A * 10/1975 Ostrander ..... 2/325
3,969,836 A * 7/1976 DuBois ..... 40/665
4,052,773 A * 10/1977 Nesbitt ..... 24/163 K
4,377,939 A * 3/1983 Reinsdorf ..... 63/3
4,477,949 A * 10/1984 Calabro ..... 24/180
4,502,188 A * 3/1985 Kohli ..... 24/163 K
4,715,839 A * 12/1987 Ford et al. ..... 446/28
5,179,766 A * 1/1993 Matusek ..... 24/163 K
5,379,493 A * 1/1995 Wu ..... 24/163 K
6,182,388 B1 * 2/2001 Patton ..... 40/640
6,594,871 B2 * 7/2003 Hoffman ..... 24/303
6,886,724 B2 * 5/2005 Hung ..... 224/163
7,784,655 B2 * 8/2010 Su ..... 224/163
8,001,661 B2 * 8/2011 Clark ..... 24/303
8,245,892 B2 * 8/2012 Kriner ..... 224/163
8,387,412 B2 * 3/2013 O'Byrne ..... 63/40
8,544,705 B2 * 10/2013 Su ..... 224/163
2004/0099702 A1 * 5/2004 Conner ..... 224/163
2007/0151084 A1 * 7/2007 Long ..... 24/303
2007/0193003 A1 * 8/2007 Matusek et al. ..... 24/163 K
2008/0120814 A1 * 5/2008 Matusek et al. ..... 24/186
2009/0096982 A1 * 4/2009 Heim ..... 351/52
2010/0032461 A1 * 2/2010 Kriner ..... 224/163
2012/0284972 A1 * 11/2012 Hafdal et al. ..... 24/457

* cited by examiner

*Primary Examiner* — Robert J Sandy
*Assistant Examiner* — Caroline L Natirboff
(74) *Attorney, Agent, or Firm* — Robert L. Shaver; Shaver & Swanson, LLP

(57) ABSTRACT

Disclosed is a belt buckle assembly with magnetically interchangeable faceplates. The faceplate attaches to a base plate by a magnetically active plate on both the base plate and the faceplate. The base plate is concealed by the faceplate when the belt buckle is assembled and in use. The user's belt is attached by a belt loop at one end of the base plate and a post on the back side of the base plate which protrudes through a hole in the belt end opposite the belt loop.

2 Claims, 3 Drawing Sheets

BELT BUCKLE SYSTEM

PRIORITY/CROSS-REFERENCE TO RELATED APPLICATIONS

This application claims the benefit of U.S. Provisional Application No. 61/505,429, filed Jul. 7, 2011, the disclosure of which is incorporated by reference.

TECHNICAL FIELD

The presently disclosed and claimed inventive concepts generally relate to a system for buckling a belt, and more particularly to belt buckles having interchangeable faceplates.

BACKGROUND

It is known in the art that belts and belt buckles are often used to compliment the fashion aspect of a particular clothing outfit. Belts and belt buckles have specific shapes, designs or colors which lead to improved aesthetic value with a particular combination of clothing. Because of this, multiple belt and belt buckles, of different shapes of buckles, widths and colors of belts, color of buckles, and of different materials are required in order to coordinate the belt and buckle with a variety of outfits a consumer may wear.

Such variety in belts and belt buckles is both expensive and requires significant space for storage and organization. The prior art utilizes faceplates and magnets to create a buckle in which part of the face of the buckle can be changed, using a magnetic insert. However, the belt buckle remains the same shape and is attached to the same belt. Thus the prior art system is not really a system of interchangeable belts and belt buckles. These systems are thus not optimized for aesthetic form and function.

SUMMARY OF THE DISCLOSURE

The invention relates to a belt buckle made up of a base plate that is magnetically attached to an interchangeable face plate. The base plate has a first side and a second side, with the first side facing the wearer, and the second side facing away from the wearer. Multiple belts of different sizes colors and material may have a compatible base plate, and a variety of face plates can be matched with the belts to achieve variety in the combined belts and buckles, and add versatility to this article of clothing. The base plate attaches to the belt on one end by a belt attachment loop, such as a D or oval shaped ring. The other end of the belt is attachable to the base plate by a post that penetrates through the holes in a standard belt. Other common belt securing systems can be used, such as a friction grip or one which utilizes jaws to secure the end of the belt.

On the side opposite of the post, termed the second side, the base plate has a magnetically responsive plate for attaching the faceplate. This could be a magnet, or a piece of metal which is attracted to a magnet.

The faceplate has a first side and a second side, with the first side of the face plate attachable to the second side of the base plate. The faceplate also contains a magnetically responsive plate on one side, which can be a magnet or a metal which is attracted to a magnet. The faceplate itself can have a desired shape which contributes to the effect, such as round, oval, rectangular, square, or other common shapes, and can be small or large. The second side of the faceplate has a design. The design can be a fashion choice, or may display a team or club emblem, graphic, or color, such as skins or other colors along with various textures and patterns. Thus the second side of the faceplate can be a material, like leather, chromed metal, silver, alligator, lizard, and can be different colors. It can have art work such as animals, words, symbols, crests, carvings, inlays, and other forms of art typical for belt buckles.

At least one of the magnetically responsive plates on these parts is a magnet, and the other may be a second magnet or a metal plate that is attracted to a magnet. The faceplate is interchangeable with other faceplates and belts, to allow the user alternate designs using the same base plate form on different belts.

The faceplate is designed to fully cover the base plate when the two pieces are connected. The base plate of the buckle can be many shapes, including having a generally rectangular shape. The faceplate has a recess in which the base plate fits, concealing the base plate from view. When connected, the belt buckle has the appearance of a solid belt buckle. The customer chosen design, logo, or color on the faceplate is the only portion of the buckle that is visible to onlookers.

The purpose of the Abstract is to enable the public, and especially the scientists, engineers, and practitioners in the art who are not familiar with patent or legal terms or phraseology, to determine quickly from a cursory inspection, the nature and essence of the technical disclosure of the application. The Abstract is neither intended to define the inventive concept(s) of the application, which is measured by the claims, nor is it intended to be limiting as to the scope of the inventive concept(s) in any way.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature.

DEFINITIONS

Figure 1:
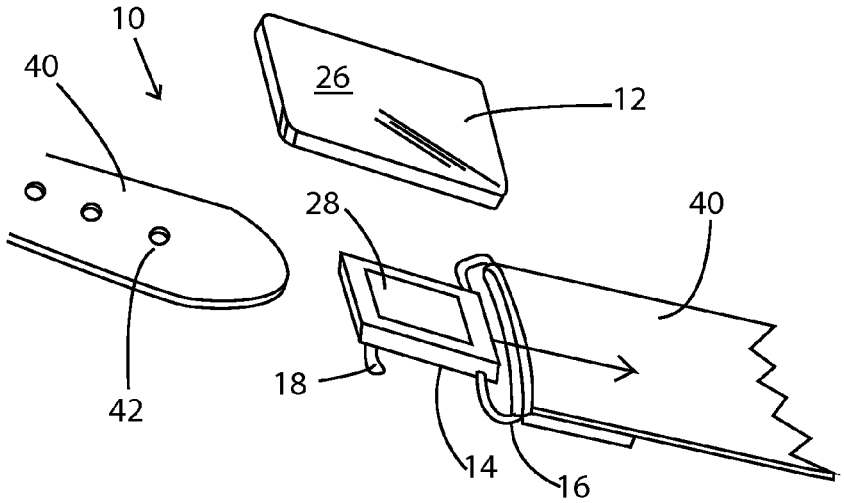
FIG. 1 is a perspective view of the belt buckle illustrating how it attaches to a belt.

In the following description and in the figures, like elements are identified with like reference numerals.

DETAILED DESCRIPTION OF THE EXEMPLARY EMBODIMENTS

While the presently disclosed inventive concept(s) is susceptible of various modifications and alternative constructions, certain illustrated embodiments thereof have been shown in the drawings and will be described below in detail.

It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

FIGS. 1-6 show the claimed belt buckle assembly. FIG. 1 show the belt buckle assembly 10 that uses interchangeable faceplates 12 on a base plate 14, for attachment to belt straps 40. The faceplate and the base plate are attached to each other by magnetic plates 28 and 30. The magnetic plates can both be magnets, or one can be a magnet and the other can be a metal plate that is attracted to the magnet. The buckle assembly included a belt loop 16, which attaches to a belt strap 40. The belt strap 40 circles the user's waist and the end of the belt strap passes through the buckle for attachment of a hook into holes 42 in the belt strap.

Figure 2:
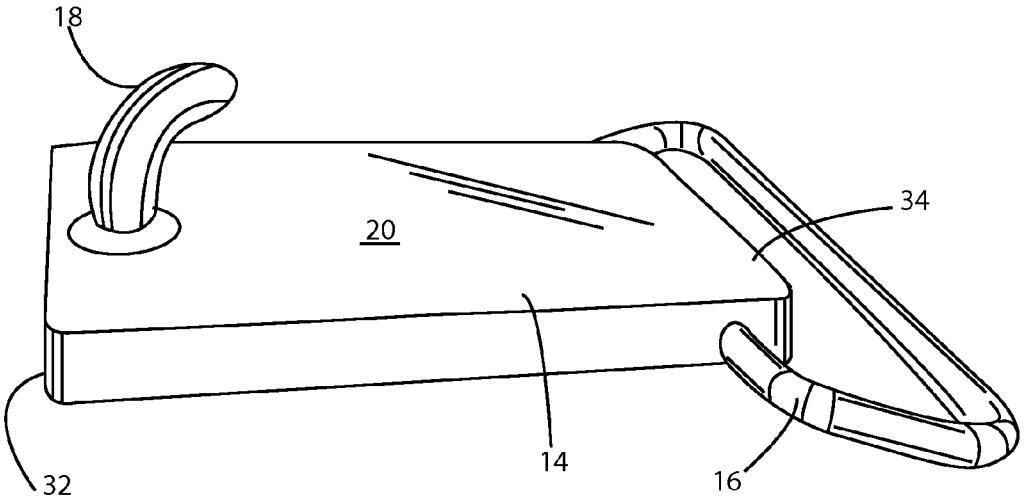
FIG. 2 is a perspective view of the back side of the base plate.
Figure 3:
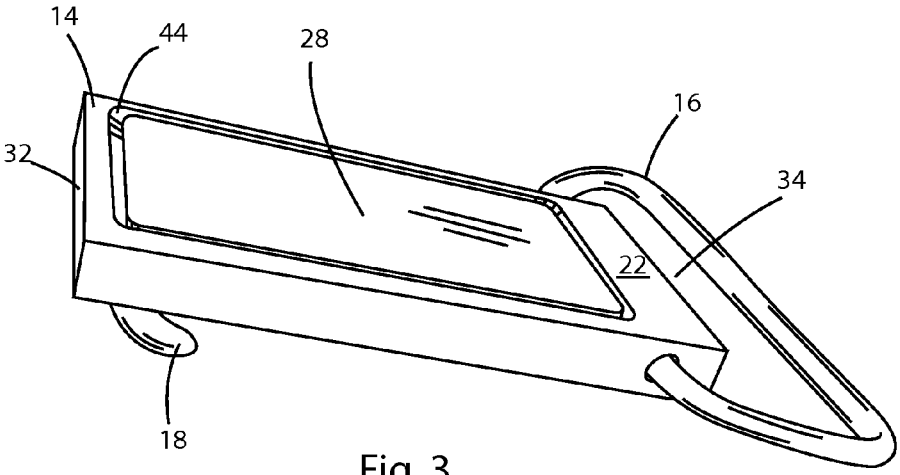
FIG. 3 is a perspective view of the front side of the base plate.

FIG. 2 shows the base plate 14, with a first side 20, a first end 32, and a second end 34. The base plate can be made of metal, with steel, aluminum, brass, or other materials being possible. Zinc is a preferred material of the base unit. Shown in FIG. 2 is the hook 18, which engages the holes 42 of the belt strap. The hook 18 is curved and forms an arc which is about ¼ of a circle. Shown is the belt loop 16, to which the belt strap 40 is attached, and threw which the end of the belt strap passes when the belt is assembled for wear. FIG. 3 shows the second side 22 of the base plate 14, and includes a cavity 44 in which the first magnet plate 28 is secured. The first magnet plate can be attached in various ways, with an adhesive or epoxy being preferred attachment means. The recess 44 has a depth that results in the top of the first magnet plate 28 being flush with the second side 22 of the base plate.

Figure 4:
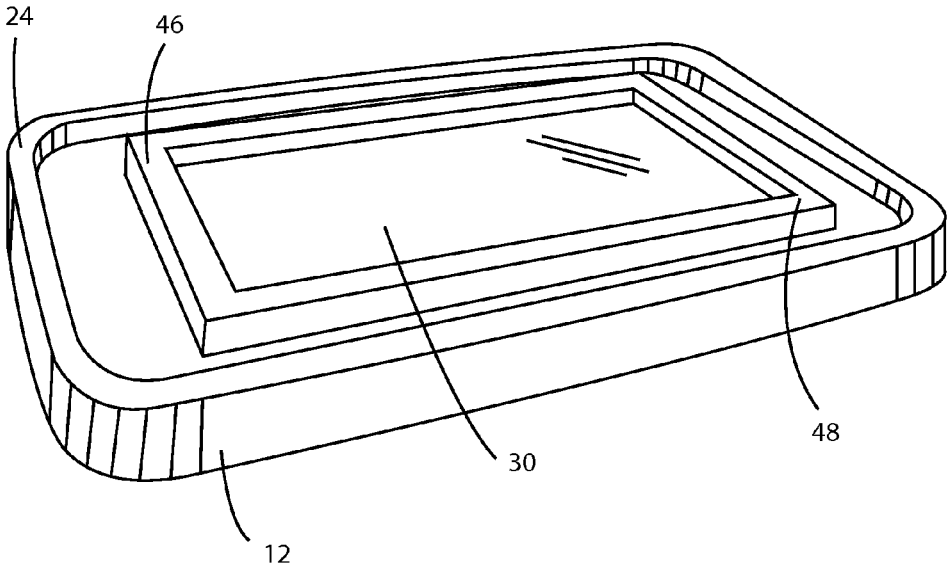
FIG. 4 is a perspective view of the back side of the faceplate.

FIG. 4 shows the faceplate 12, showing the first side 24 of the face plate and the second magnet plate 30. The second magnet plate 30 is surrounded by a frame 48 which positions the second magnet plate, and places it slightly below the top surface 46 of the frame 48.

Figure 5:
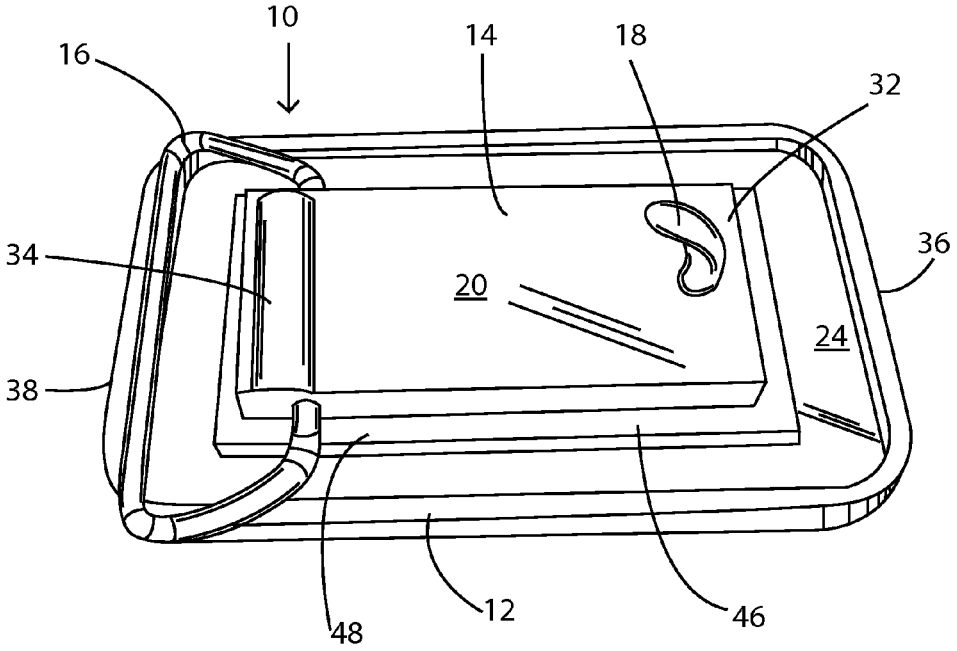
FIG. 5 is a perspective view of the back side of the assembled belt buckle.

FIG. 5 shows the base plate 14 and the faceplate 12 joined together, with the sides of the base plate 14 fitting within the inner cavity of the frame 48. Since the first magnet plate 28 is flush with the first side of the base plate, maximal magnetic contact and force is available to hold the two magnetic plates together. As shown in FIG. 5, the faceplate completely covers the base plate, so the base plate is not visible when the buckle assembly is worn. The face plate extends beyond the sides of the base plate by about half the width of the base plate on all sides. The base plate fits within and is surrounded by the frame 48 of the faceplate. This results in a structure which does not allow the faceplate to be twisted apart from the baseplate.

FIG. 5 shows the 1$^{st}$ end 36 of the faceplate, and the 2$^{nd}$ end 38 of the faceplate.

This amendment adds no new matter, since these features had been originally disclosed in FIG. 5.

Figure 6:
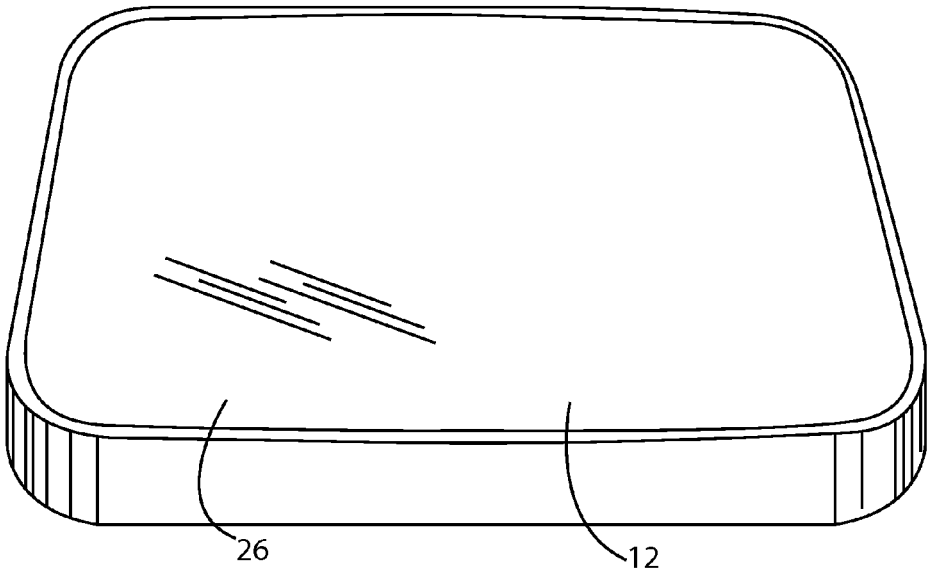
FIG. 6 is a perspective view of the front side of the faceplate.

FIG. 6 shows the faceplate 12 and the second side 26 of the faceplate. This is the side that is visible when the belt buckle assembly 10 is worn. The surface of the second side 26 of the faceplate 12 can be different colors, designs, logos, artwork, and can be an insert of different materials such as leather, wood, metals. All of these fall within the term "decorative image", which may refer to a color of pattern of colors with no particular image. The faceplate can be different shapes, such as rectangular, round, oval, or other shapes, and can be large or small. The faceplate can be as small as the dimension of the frame 48, so that the base plate can sit inside the walls of the frame 48.

While certain exemplary embodiments are shown in the Figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. A belt buckle system with an interchangeable face plate, comprising:

a base plate with a first side and a second side, and a first end and a second end, with a post for engagement with belt holes attached to and extending from said first side of said first end, and a base plate magnet mounting recess defined in said second side of said base plate for attachment of a first magnetically responsive plate, and with a belt attachment loop attached on said second end of said base plate;

said first magnetically responsive plate, having a width and a length, and attached to said second side of said base plate in said base plate magnet mounting recess in said second side of said base plate, said first magnetically responsive plate is flush with a surface of said second side of said base plate, and in which said base plate fits inside a faceplate magnet mounting recess;

a faceplate with a first side and a second side, with said faceplate magnet mounting recess defined in said first side of said face plate and a second magnetically responsive plate attached to said faceplate magnet mounting recess, said faceplate with a decorative image on said second side, with at least one of said first magnetically responsive plate or said second magnetically responsive plate being a magnet, said faceplate configured for magnetic attachment to said base plate, and with said faceplate fully covering said second side of said base plate, and extending beyond the edges of said second side of said base plate, with said faceplate attachable to said base plate by attraction of said first and second magnetically responsive plates, and said faceplate interchangeable with other faceplates with alternative designs.

2. A belt buckle system with an interchangeable face plate, comprising:

a generally rectangular base plate with a first side and a second side, and a first end and a second end, with a post for engagement with belt holes attached to and extending from said first side of said first end, and a base plate magnet mounting recess defined in said second side of said base plate for attachment of a first magnetically responsive plate, with said base plate magnet mounting recess sized for said first magnetically responsive plate to be flush with a surface of said second side of said base plate, said base plate with a belt attachment loop with a straight side for belt attachment, attached to said second end of said base plate;

said first magnetically responsive plate, having a width and a length, and attached to said second side of said base plate in said base plate magnet mounting recess in said second side of said base plate;

a faceplate with a first side and a second side, with a faceplate magnet mounting recess defined in said first side of said faceplate for mounting a second magnetically responsive plate, with said faceplate magnet mounting recess sized so that said second magnetically responsive plate is recessed in said faceplate magnet mounting recess, and sized to receive and surround said generally rectangular base plate in said faceplate magnet mounting recess, said faceplate with a decorative image on said second side, with at least one of said first or second magnetically responsive plates being a magnet, said faceplate configured for magnetic attachment to said base plate, and with said faceplate fully covering said second side of said base plate, and extending beyond the edges of said second side of said base plate, with said faceplate attachable to said base plate by attraction of said first and second magnetically responsive plates, and said faceplate interchangeable with other faceplates with alternative designs.

* * * * *